US012635804B2

(12) United States Patent
White

(10) Patent No.: US 12,635,804 B2
(45) Date of Patent: May 26, 2026

(54) MODULAR VEHICLE PLATFORM SYSTEM

(71) Applicant: Hele Outdoors, LLC, Longmont, CO (US)

(72) Inventor: Murray Justin White, Longmont, CO (US)

(73) Assignee: Hele Outdoors, LLC, Longmont, CO (US)

( * ) Notice: Subject to any disclaimer, the term of this patent is extended or adjusted under 35 U.S.C. 154(b) by 0 days.

(21) Appl. No.: 19/030,946

(22) Filed: Jan. 17, 2025

(65) Prior Publication Data

US 2025/0160526 A1 May 22, 2025

Related U.S. Application Data

(60) Provisional application No. 63/551,175, filed on Feb. 8, 2024.

(51) Int. Cl.

| | |
|---|---|
| ***A47C 17/80*** | (2006.01) |
| ***A47B 3/06*** | (2006.01) |
| ***A47B 9/14*** | (2006.01) |
| ***A47C 17/64*** | (2006.01) |
| ***A47C 17/76*** | (2006.01) |
| ***A47C 17/86*** | (2006.01) |

(52) U.S. Cl.

CPC ..... *A47C 17/80* (2013.01); *A47B 3/06* (2013.01); *A47B 9/14* (2013.01); *A47C 17/645* (2013.01); *A47C 17/76* (2013.01); *A47C 17/86* (2013.01)

(58) Field of Classification Search

CPC ..... A47C 17/80; A47C 17/645; A47C 17/76; A47C 17/86; A47B 3/06; A47B 9/14

USPC ..... 5/11

See application file for complete search history.

(56) References Cited

U.S. PATENT DOCUMENTS

| | | | | | |
|---|---|---|---|---|---|
| 758,211 | A * | 4/1904 | Jones | A47C 17/66 | 5/310 |
| 1,080,577 | A * | 12/1913 | Pascale et al. | A47C 17/68 | 5/187 |
| 1,135,707 | A * | 4/1915 | Mattes | A47C 17/64 | 135/96 |
| 2,992,442 | A * | 7/1961 | Lehman | A47D 7/002 | D6/392 |

(Continued)

FOREIGN PATENT DOCUMENTS

| | | | | |
|---|---|---|---|---|
| DE | 2360700 | A * | 3/2001 | A47B 3/02 |

OTHER PUBLICATIONS

Generic, "Generic Folding Picnic Camping Table", Dec. 8, 2021, Amazon, pp. 1-3 (Year: 2021).*

*Primary Examiner* — Justin C Mikowski
*Assistant Examiner* — Luke Hall
(74) *Attorney, Agent, or Firm* — University of San Francisco School of Law; Najma Ali; Natalie Buck

(57) ABSTRACT

A modular vehicle platform system includes a frame, topper, and carrying case. Components of the frame are disassembled and compactly fit into the carrying case along with the topper. The frame consists of multiple support bars, poles, angle brackets, and interchangeable legs that can be adjusted to fit different vehicle configurations. Short legs and extendable legs can be swapped to modify the height of the platform, allowing for customized use in a variety of settings. The topper is constructed from slats connected by stretchable straps, providing a sturdy surface that can support a person.

14 Claims, 10 Drawing Sheets

(56) References Cited

U.S. PATENT DOCUMENTS 3,007,180 A * 11/1961 Zaugg ..... A61G 1/056 5/9.1
3,093,837 A * 6/1963 Clayton ..... A47D 13/063 5/111
3,097,368 A * 7/1963 Collins ..... A47C 17/66 5/112
3,336,060 A * 8/1967 Bradford ..... A61G 1/003 5/8
3,426,367 A * 2/1969 Bradford ..... A61G 1/013 5/628
3,620,428 A * 11/1971 Silverthorne ..... A45F 3/08 224/156
3,846,855 A * 11/1974 Peterson ..... A45F 4/06 224/156
3,912,138 A * 10/1975 Pava ..... A45F 4/04 24/453
4,056,857 A * 11/1977 Quantz ..... A45F 4/06 5/112
4,212,377 A * 7/1980 Weinreb ..... A45C 13/02 190/110
4,685,160 A 8/1987 Rizzardo
4,688,281 A 8/1987 Lantz
4,993,088 A 2/1991 Chudik
5,117,952 A * 6/1992 Suh ..... A45C 13/36 190/127
5,241,959 A 9/1993 Kim et al.
5,356,004 A * 10/1994 Weinreb ..... A45C 11/38 190/110
5,490,649 A 2/1996 Kusalich
5,500,007 A 3/1996 Kim et al.
6,533,260 B1 3/2003 Mock
7,103,928 B1 9/2006 Childs
7,313,835 B1 * 1/2008 Hodges ..... A47C 17/645 5/187
7,607,182 B1 * 10/2009 Weiner ..... A47G 9/062 5/418
7,681,524 B1 * 3/2010 Hudson ..... A01K 1/0107 119/28.5
8,919,284 B2 * 12/2014 Wolfe, Jr. ..... A01K 15/02 119/28.5
11,076,702 B2 * 8/2021 Zhang ..... A47C 17/645
11,241,346 B1 2/2022 Haas et al.
2005/0011002 A1 * 1/2005 Hunter ..... A47C 17/645 5/9.1
2009/0200820 A1 * 8/2009 Smith, Jr. ..... B60P 3/341 296/3
2010/0043139 A1 * 2/2010 Bonatz ..... A47C 19/005 5/503.1
2010/0319123 A1 12/2010 Bonatz
2014/0083335 A1 * 3/2014 Mayhood ..... E04H 15/06 108/18
2014/0250593 A1 * 9/2014 Kim ..... A47C 4/024 108/159
2019/0380506 A1 12/2019 Calhoun
2022/0400866 A1 * 12/2022 Fillingham ..... A47C 4/28
2024/0040991 A1 2/2024 Conn et al.
2025/0000269 A1 1/2025 Frick et al.

* cited by examiner

MODULAR VEHICLE PLATFORM SYSTEM

CROSS REFERENCE TO RELATED APPLICATIONS

This application claims the benefit under 35 U.S.C. § 119 from U.S. Provisional Patent Application Ser. No. 63/551,175, entitled "3 in 1 Modular Vehicle Platform System," filed on Feb. 8, 2024, the subject matter of which is incorporated herein by reference.

TECHNICAL FIELD

The present invention relates generally to a sleeping and storage system, and more specifically, to a modular platform system.

BACKGROUND INFORMATION

The stress and pressures of an ever evolving society has made escaping to the outdoors in search of relief through nature a growing need. Many outdoor enthusiasts seek ways to transform their own vehicles into comfortable sleeping and storage spaces for camping and adventuring. The challenge is not only cost effectiveness, but adaptability to a wide range of vehicles, such as SUVs, vans, and pick up trucks. Traditional vehicle sleeping and storage solutions often involve custom-built platforms that are specific to one's particular vehicle model.

SUMMARY

A vehicle platform system includes a frame, topper, and carrying case. Components of the frame are disassembled and compactly fit into the carrying case along with the topper. The vehicle platform system provides a modular, adjustable vehicle-camping platform designed to enhance stability, storage, and versatility for SUVs, trucks, and vans. The carrying case features adjustable partitions to neatly organize and secure all components, ensuring convenient portability. This modular design allows users to set up and dismantle the system quickly, making it suitable for temporary or semi-permanent installations in different vehicles.

The frame consists of multiple support bars, poles, angle brackets, and interchangeable legs that can be adjusted to fit different vehicle configurations. Short legs and extendable legs can be swapped to modify the height of the platform, allowing for customized use in a variety of settings. In addition, each leg is height adjustable allowing users to adjust the frame to a desired height as well as navigate various obstacles that might impede the frame.

The topper is constructed from slats connected by stretchable straps, providing a flexible yet sturdy surface that can support a person. Shaft collars secure the topper to the front and rear support bars, ensuring stability while maintaining ease of assembly. The topper can be made of wood, metal, composite, or other strong materials to provide durability and reliability.

The vehicle platform system offers versatility for multiple applications, including camping, vehicle-based workstations, storage solutions, and emergency sleeping arrangements. Its lightweight, portable, and adaptable design makes it an ideal solution for users who require a customizable platform that can be easily set up, adjusted, and stored. By integrating interchangeable components and compact storage, the modular vehicle platform system provides an efficient, space-saving solution for optimizing vehicle interiors.

The novel modular vehicle platform system provides many advantages over commercially available systems. Conventional custom-built platforms are bulky, heavy, and difficult to store. Additionally, there is a challenge of needing both carpentry skills and tools to construct a custom-built platform. This makes it increasingly difficult for individuals who live in smaller spaces (apt buildings, studios, etc.) that cannot store the platform or the tools to build it.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will w be made in detail to some embodiments of the invention, examples of which are illustrated in the accompanying drawings.

Figure 1:
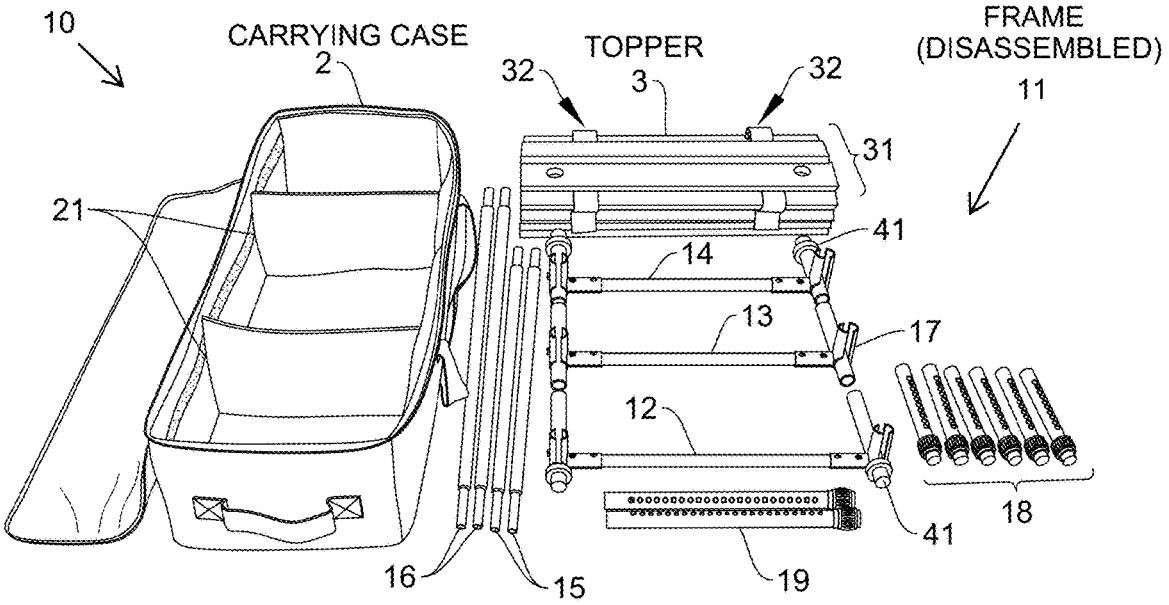
FIG. 1 is a diagram of a modular vehicle platform system 10 in accordance with one embodiment.

FIG. 1 is a diagram of a modular vehicle platform system 1 in accordance with one embodiment. Disassembled components of the modular vehicle platform system 10 are shown in FIG. 1. The modular vehicle platform system 10 comprises a carrying case 2, a topper 3, and a frame 11. The carrying case 2 comprises adjustable partitions 21. The carrying case 2 stores all components of the modular vehicle platform system 10 allowing for ease of storage and transport.

The frame includes a rear center support bar 12, a middle center support bar 13, and a front center support bar 14. When the frame 11 is assembled, the short poles 15 extend between the rear center support bar 12 and the middle center support bar 13, and the long poles 16 extend between the middle center support bar 13 and the front center support bar 14. The frame 11 also includes angle brackets 17 positioned at the junctions of the support bars and poles. Short legs 18 extend from the ends of the rear center support bar 12, middle center support bar 13, and front center support bar 14 via the angle brackets 17. Extendable legs 19 are provided, which are swappable with the short legs 18 to extend from the rear center support bar 12, middle center support bar 13, or the front center support bar 14.

The interchangeability of components, such as the short legs 18 and extendable legs 19 enables adaptation to various vehicle interiors and usage scenarios. The topper 3 comprises a plurality of slats 31 connected by stretchable straps 32. The topper 3 is held in place by shaft collars 41 placed on the rear center support bar 12 and front center support bar 14. The topper 3 is formed from wood, metal, composite, or any suitable material of sufficient rigidity and strength to support a person.

Figure 2:
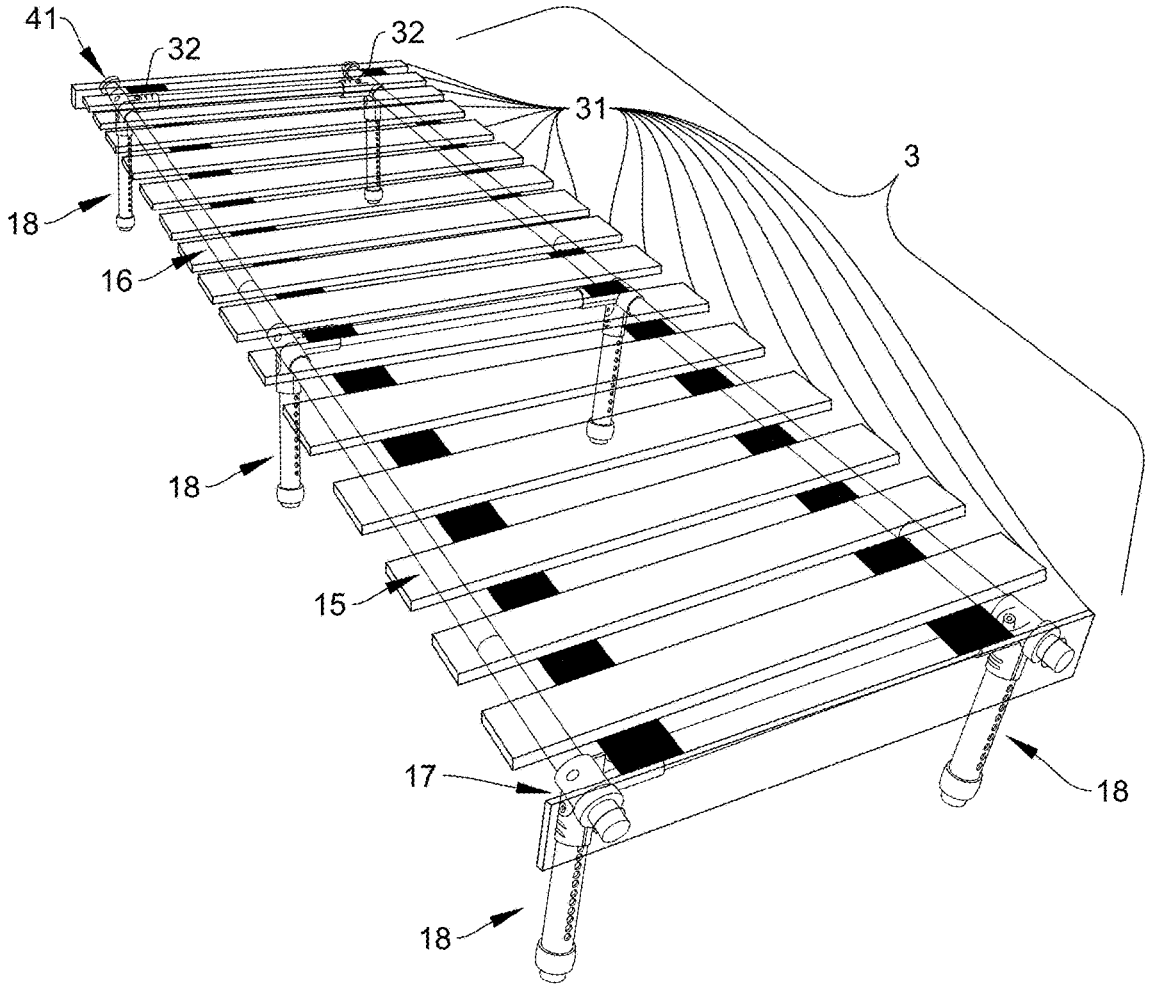
FIG. 2 is a diagram showing a perspective view of the frame assembled in the sleeping platform configuration with topper disposed over the frame.

FIG. 2 is a diagram showing a perspective view of the frame 11 assembled in the sleeping platform configuration with topper 3 disposed over the frame. The topper 3 comprises a plurality of slats 31 connected by stretchable straps 32. The topper 3 is securely fastened to the shaft collars 41. The shaft collars 41 are connected to frame 11. The topper 3 sits along the top of frame 11. The angle brackets 17 reinforce attachment between the short poles 15 and long poles 16 to the short legs 18.

Figure 3:
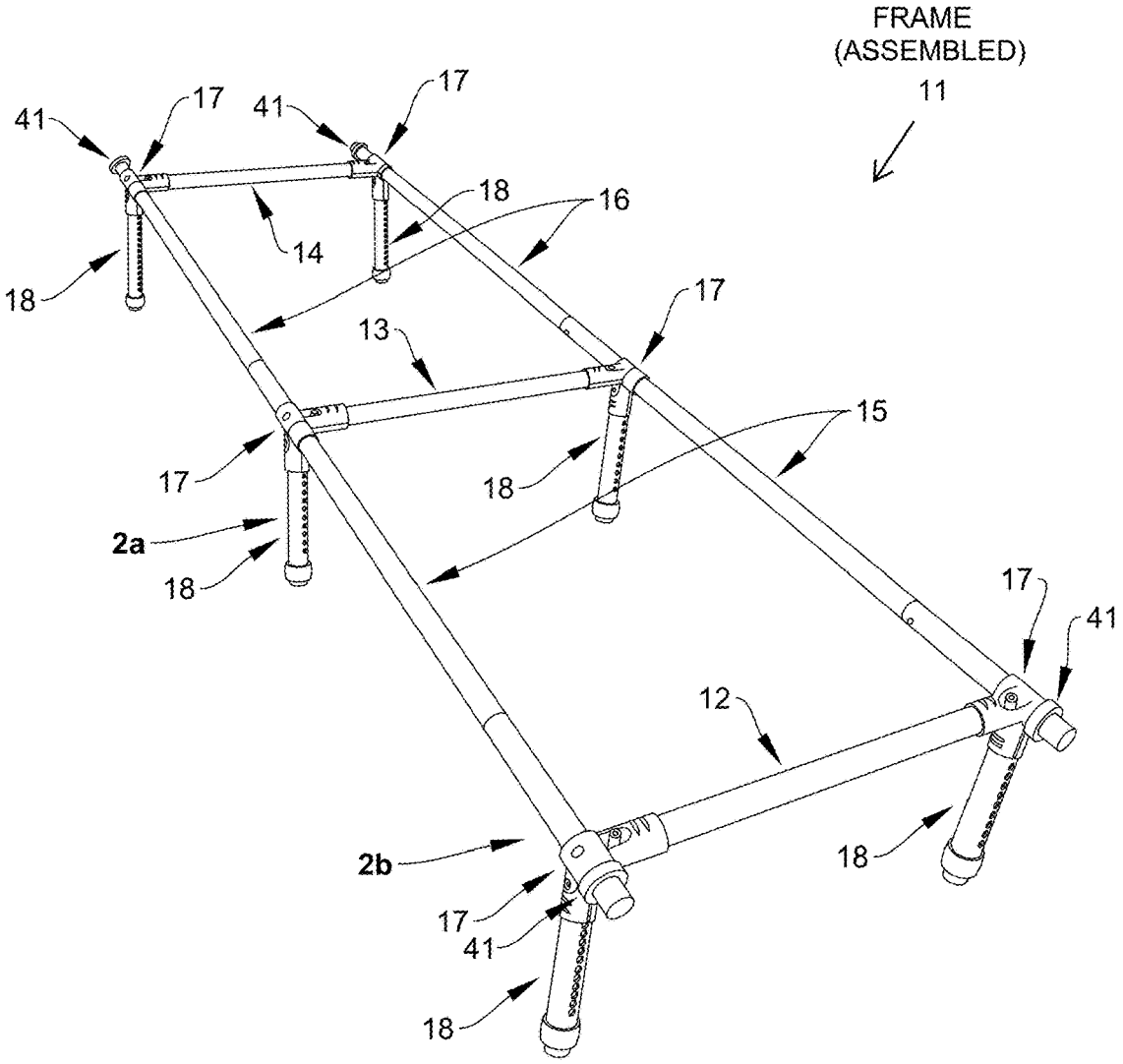
FIG. 3 is a diagram showing a perspective view of the modular vehicle platform system assembled in the sleeping platform configuration without the topper.

FIG. 3 is a diagram showing a perspective view of the modular vehicle platform system 10 assembled in the sleeping platform configuration without the topper. The frame 11 comprises a rear center support bar 12, a middle center support bar 13, and a front center support bar 14. These center support bars **6*a* are interconnected by connecting poles 6*b*, which include short poles 15 and long poles 16**.

In one embodiment, one end of a first long pole 16 connects to the front center support bar 14, while the other end connects to the middle center support bar 13. Similarly, one end of a second long pole 16 connects to the front center support bar 14, with its other end connecting to the middle center support bar 13. The short poles 15 follow a similar pattern, with one end of a first short pole 15 connecting to the middle center support bar 13 and the other end connecting to the rear center support bar 12.

The frame 11 includes multiple angle brackets 17 positioned at the junctions of the center support bars and connecting poles. These angle brackets 17 feature a reinforced bracket 42 (see FIG. 25) for added strength. The angle brackets 17 also serve as attachment points for the short legs 18 of the frame 11. In other embodiments, no reinforced bracket is included in the angle brackets.

Figure 4:
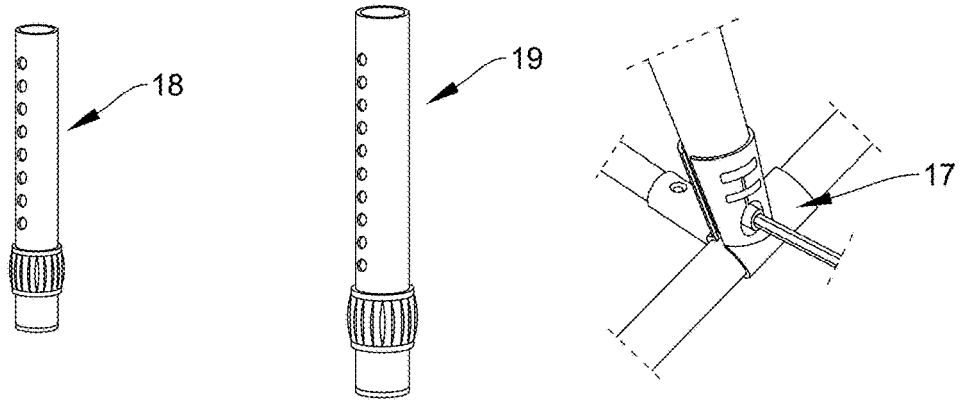
FIG. 4 is a detailed view of the short leg and extended leg, and a detailed side view of the angle brackets.

Referring now to FIG. 4, shows a detailed view of a short leg 18, an extended leg 19, and a detailed side view of the angle brackets 17. Both legs are fitted with a twist-locking mechanism 23 which provides additional stability when an adjustable height position is chosen and ensures it will not slip from that chosen position. It further shows when either a short leg 18 or an extended leg 19 when inserted into an angle bracket 17 an allen key is used to cinch the legs into place.

Figure 5:
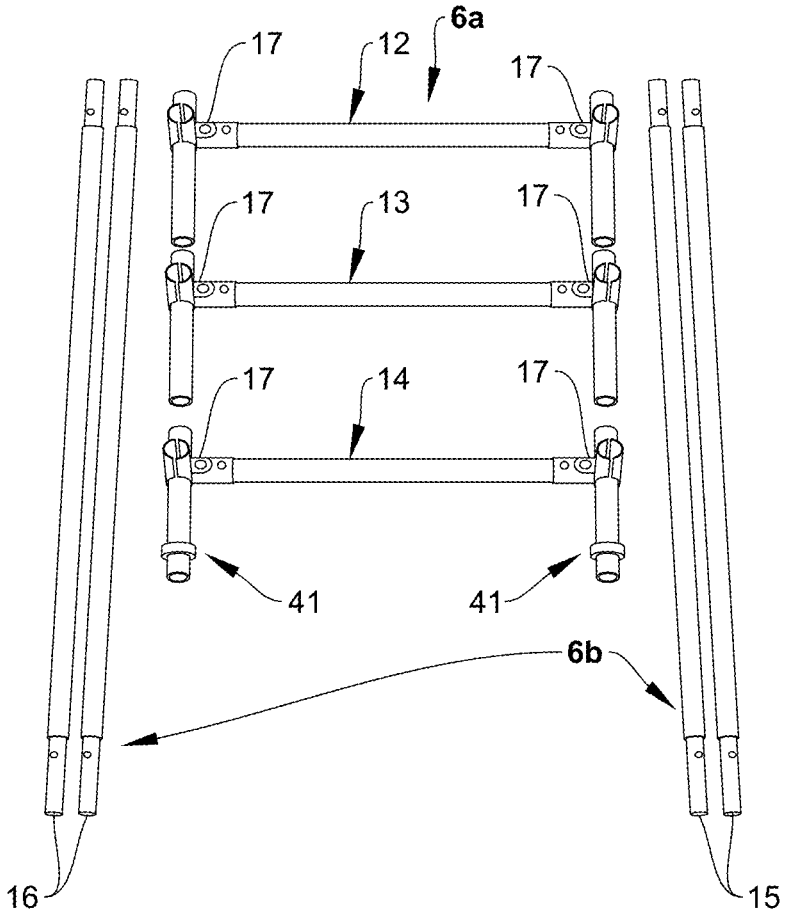
FIG. 5 is an exploded view of long poles, short poles, rear center support bar with angle brackets, middle center support bar with angle brackets, and front center support bar with angle brackets.

FIG. 5 is an exploded view of long poles 16, short poles 15, rear center support bar 12 with angle brackets 17, middle center support bar 13 with angle brackets 17, and front center support bar 14 with angle brackets 17.

Figure 6:
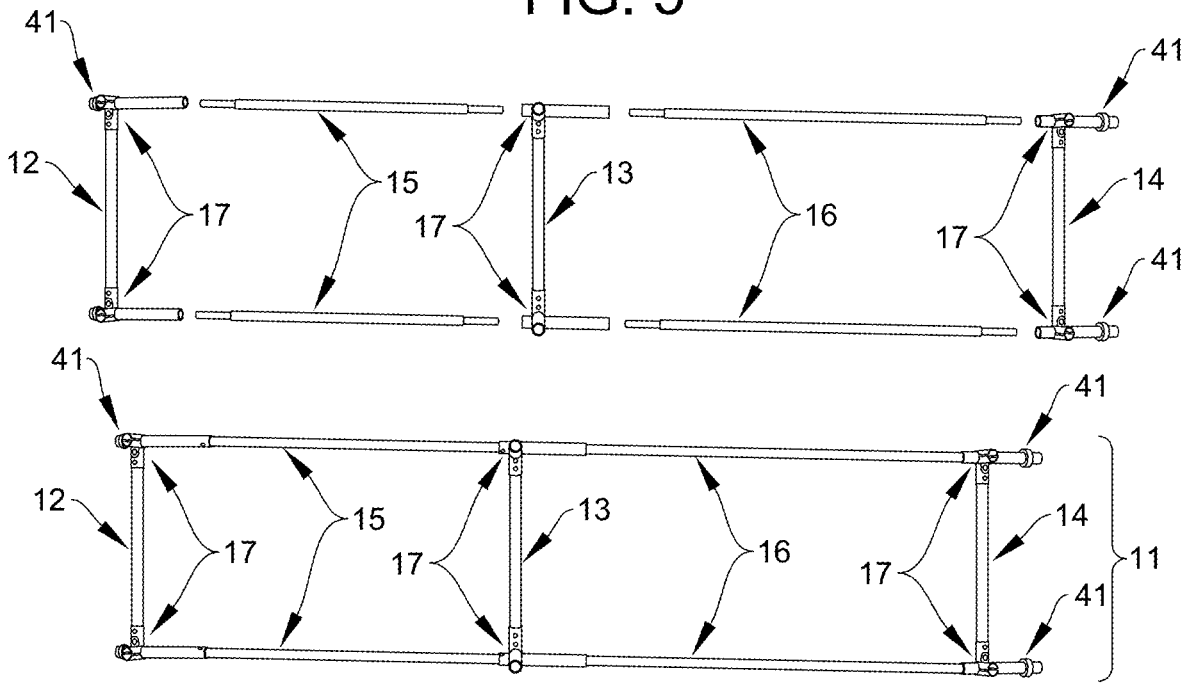
FIG. 6 is an exploded bottom view of the modular vehicle platform system in the sleeping platform configuration and its frame disassembled, and an additional bottom view of the frame assembled.

FIG. 6 is an assembled view of the frame shown in FIG. 5.

Figure 7:
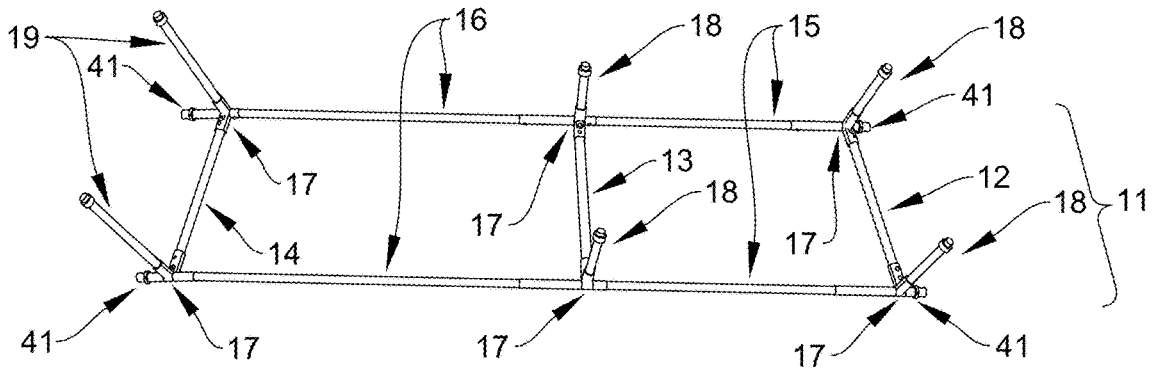
FIG. 7 is a side bottom view of the modular vehicle platform system in the sleeping platform configuration with long legs at the front end.
Figure 8:
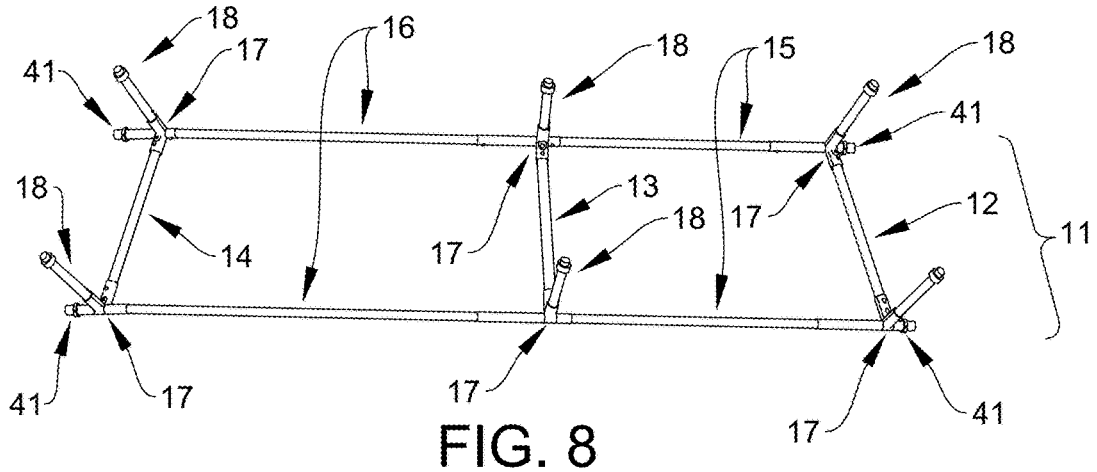
FIG. 8 is a side bottom view of the modular vehicle platform system in the sleeping platform configuration, FIG. 7, but with short legs.

FIG. 7 and FIG. 8 both show a side bottom view of the sleeping platform configuration. In FIG. 7 the frame 11 is shown with extendable legs 19 attached to the front support bar 14, while in FIG. 8, short legs 18 are used in all positions.

Figure 9:
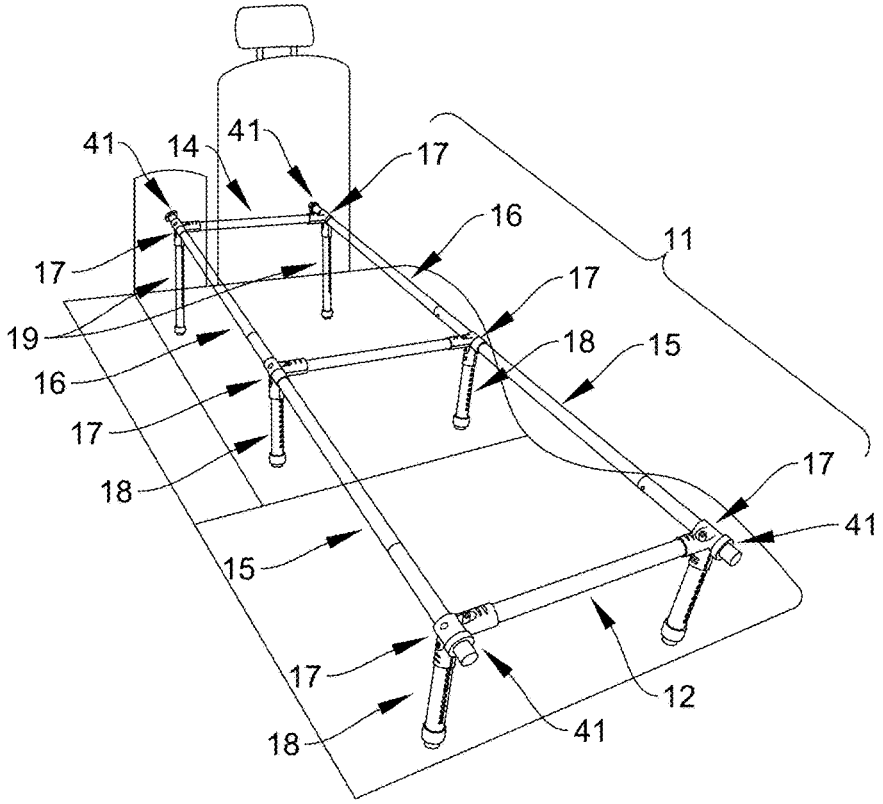
FIG. 9 is a perspective view of the modular vehicle platform system in the sleeping platform configuration without the topper.

FIG. 9 is the same embodiment of the modular vehicle platform system 10 shown in FIG. 8 but in a top perspective view.

Figure 10:
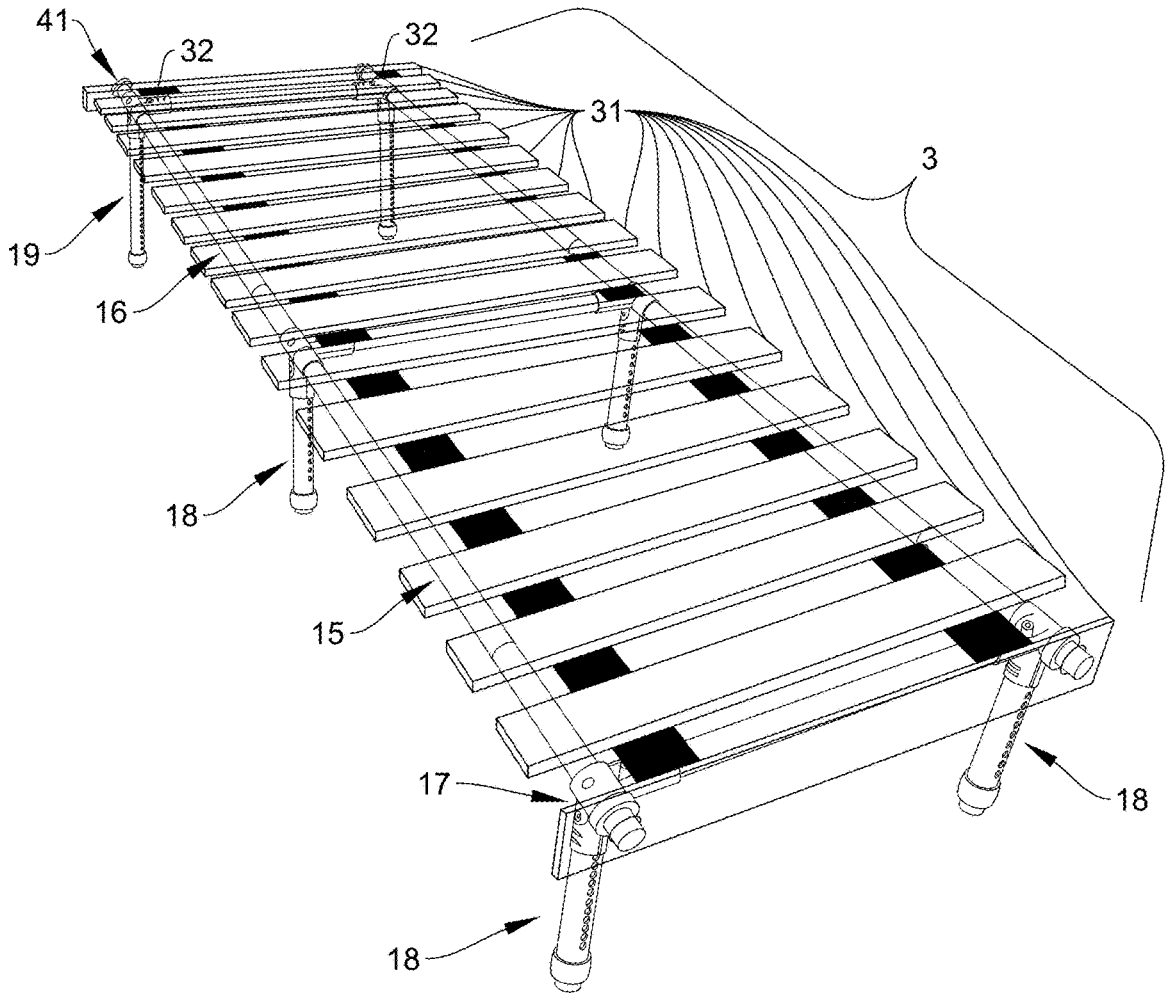
FIG. 10 is a perspective view of the modular vehicle platform system in the sleeping platform configuration.

FIG. 10 shows the modular vehicle platform system 10 with the topper 3 attached in a perspective view similar to that of FIG. 9.

Figure 11:
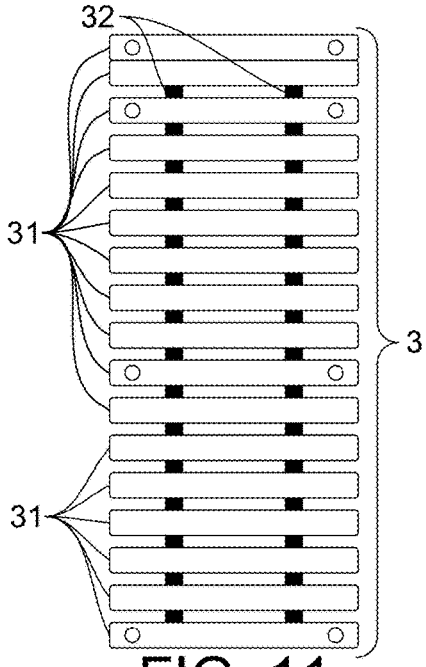
FIG. 11 is a top view of the topper and stretchable straps of the modular vehicle platform system.

FIG. 11 is a top view of the topper 3. Topper 3 includes a plurality of slats 31, plurality of stretchable straps, and a plurality of holes. The holes are located at rear, center, and front portions of the topper 3.

Figure 12:
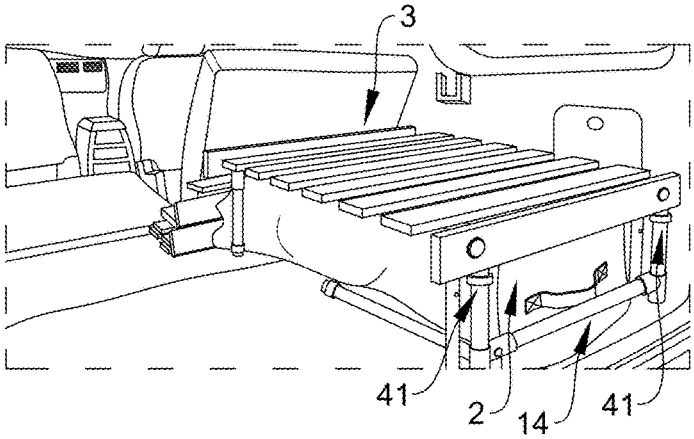
FIG. 12 is a perspective view of the preferred embodiment of the modular vehicle platform system while in the short table platform configuration with carrying case underneath, while installed in a vehicle.

FIG. 12 shows the modular vehicle platform system 10 in the short table platform 7 configuration with the topper 3 connected by the plurality of shaft collars. The carrying case 2 is shown below the modular vehicle platform system 10 in its preferred embodiment.

Figure 13:
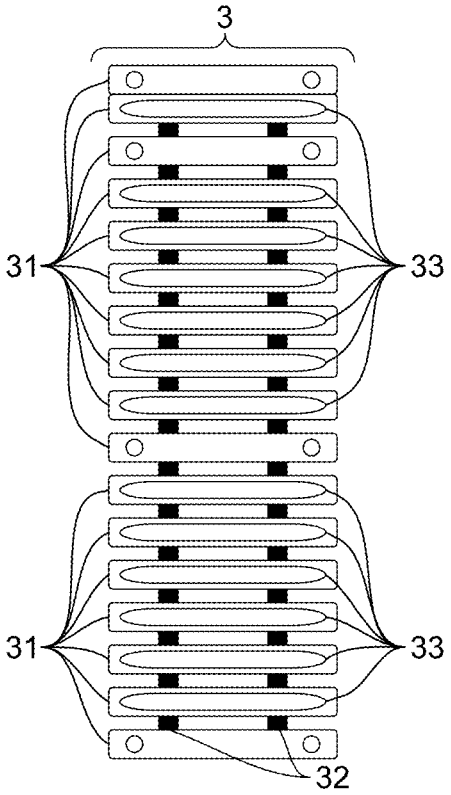
FIG. 13 is a top view of the topper, stretchable straps, and gripping tape of the modular vehicle platform system.

FIG. 13 is similar to FIG. 11 with addition of the plurality of gripping tape 33 on the plurality of slats 31 which prevents slippage.

Figure 14:
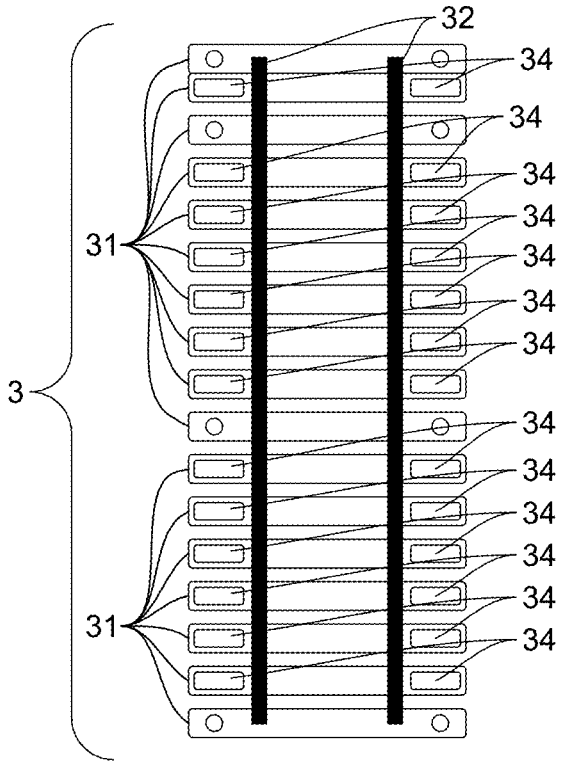
FIG. 14 is a bottom view of the topper, stretchable straps, gripping tape, and foam tape of the modular vehicle platform system.

FIG. 14 is a bottom view of the topper 3 showing the plurality of slats 31. The slats are connected by the plurality of stretchable straps 32. The slats include gripping tape 33 and a plurality of holes. The holes are located along rear, center, and front slats.

Figure 15:
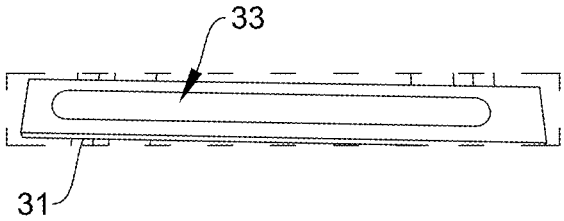
FIG. 15 is a top view of a single slat of the topper of the modular vehicle platform system.

FIG. 15 shows a solitary slat 31.

Figure 16:
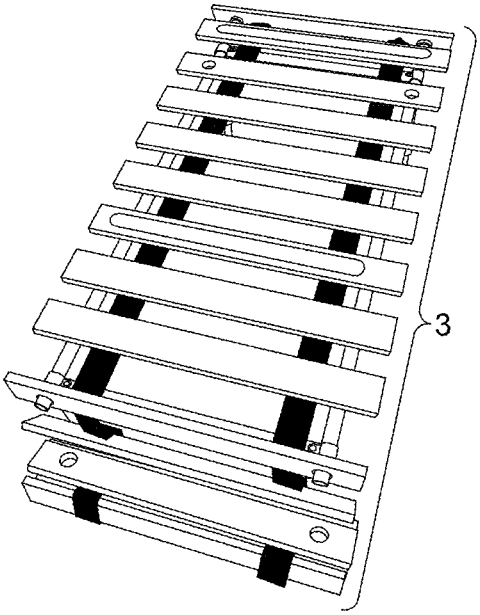
FIG. 16 is a perspective view of the preferred embodiment of the modular vehicle platform system while in the medium table platform configuration.

FIG. 16 shows the modular vehicle platform system 10 in the medium table platform 8 configuration with the topper 3 connected by the plurality of shaft collars.

Figure 17:
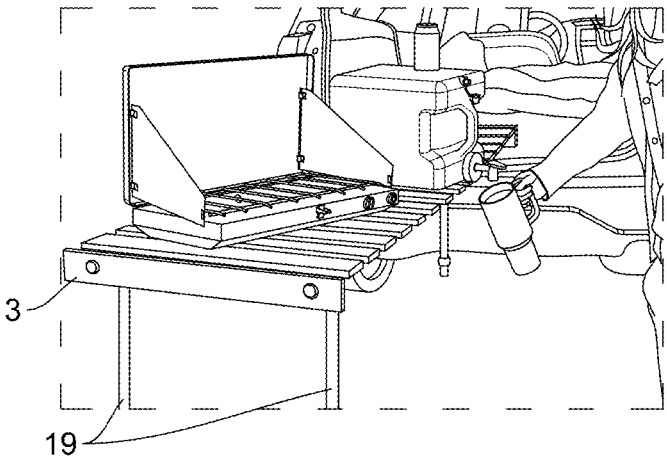
FIG. 17 is a perspective view of the preferred embodiment of the modular vehicle platform system while in the long table platform configuration extending from the back of a vehicle.

FIG. 17 shows the modular vehicle platform system 10 while in the long table platform 9 configuration. In this configuration the rear center support bar 12 sits on the vehicle itself while a plurality of shorts legs 18 are not attached.

Figure 18:
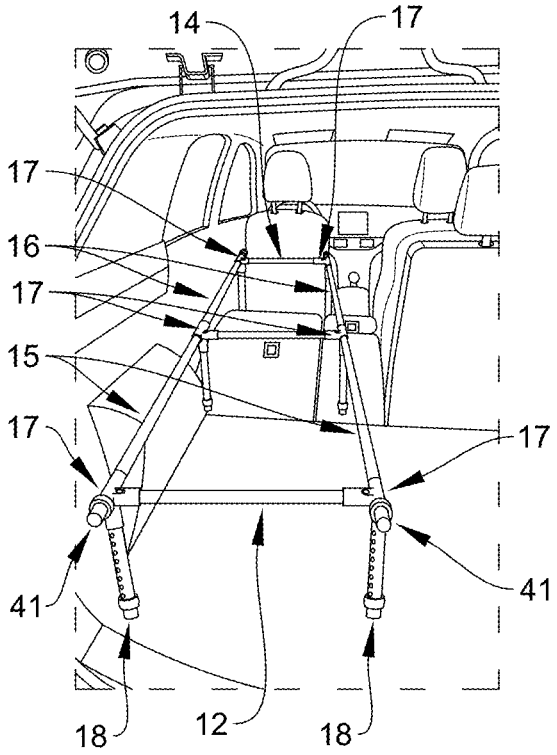
FIG. 18 is a perspective rear view of the modular vehicle platform system in the sleeping platform configuration with no topper and short legs roughly halfway extended.

FIG. 18 shows the modular vehicle platform system 10 in the sleeping platform configuration installed in a vehicle. The plurality of short legs 18 are connected to middle center support bar 13 and front center support bar 14 and are halfway extended, while the extendable legs 19 are connected to the rear center support bar 12.

Figure 19:
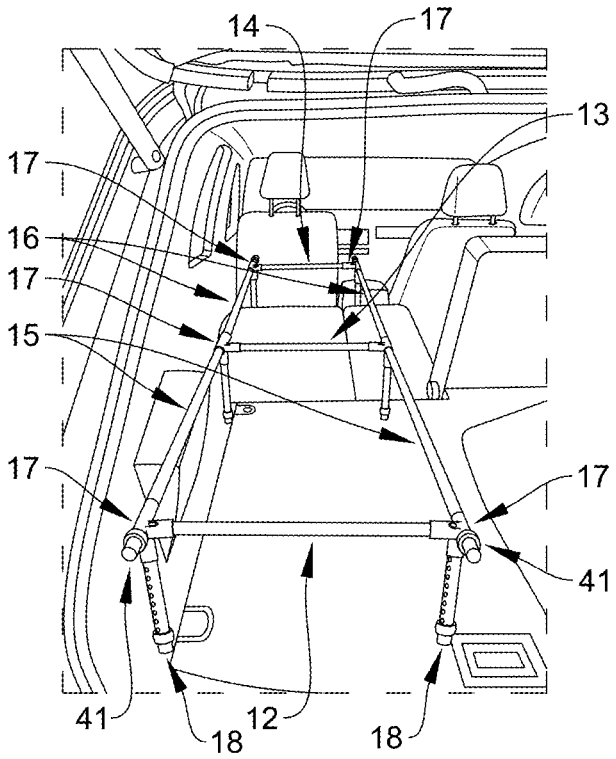
FIG. 19 is a perspective rear view of the modular vehicle platform system in the sleeping platform configuration with no topper and short legs not extended.

FIG. 19 shows the modular vehicle platform system 10 in the sleeping platform configuration installed in a vehicle. The plurality of short legs 18 are connected to middle center support bar 13 and front center support bar 14 are not extended, while the extendable legs 19 are connected to the rear center support bar 12.

Figure 20:
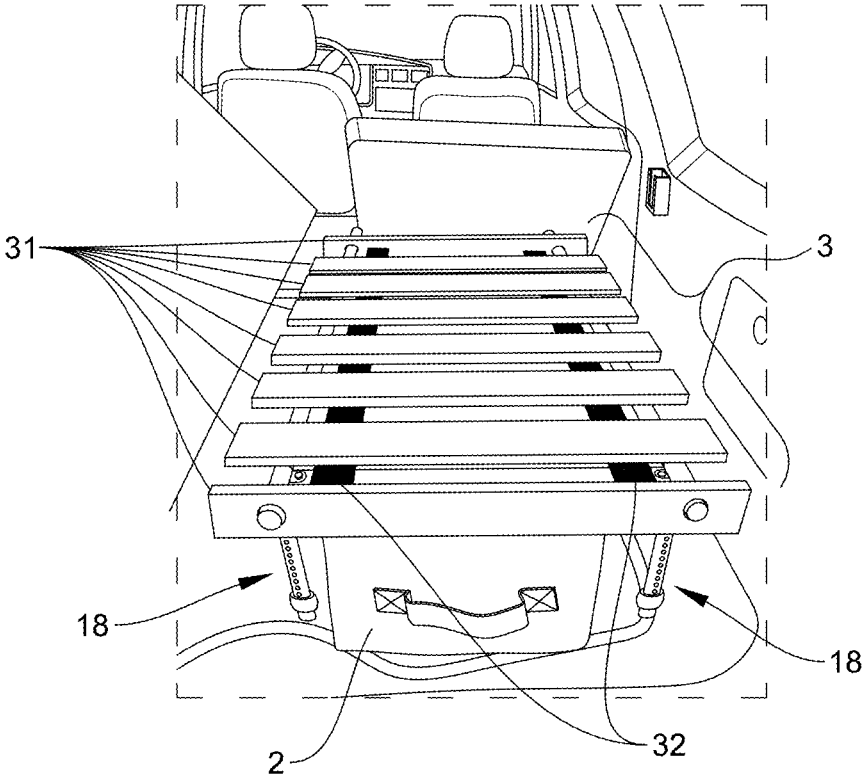
FIG. 20 is a rear view of (FIG. 12) the preferred embodiment of the modular vehicle platform system while in the short table platform configuration with carrying case underneath.

FIG. 20 which is a front perspective view of the modular vehicle platform system 10 in the short table platform 7 configuration shown in FIG. 12.

Figure 21:
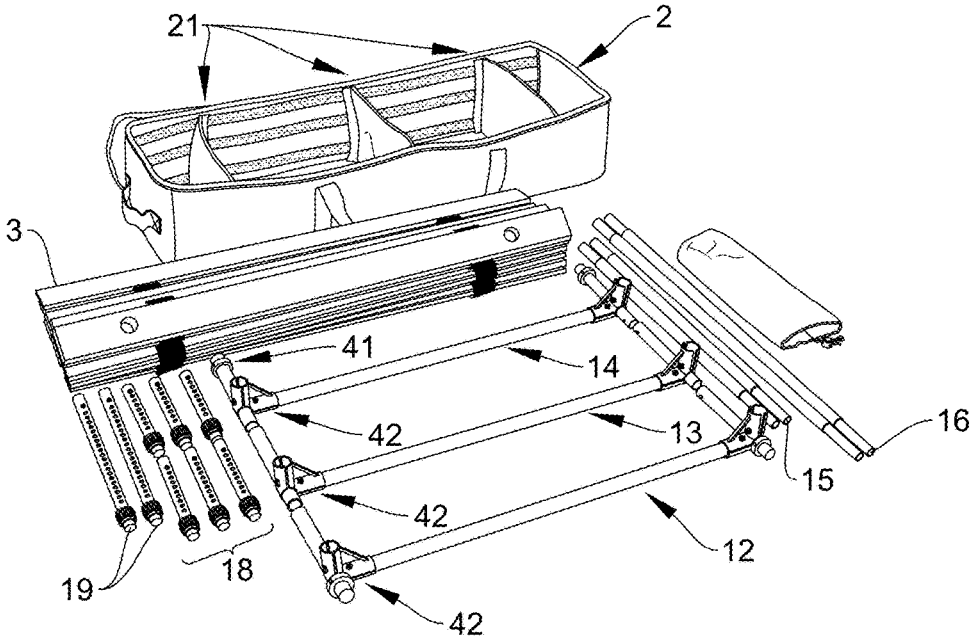
FIG. 21 is an exploded view showing all pieces included in the duo embodiment of the modular vehicle platform system.

FIG. 21 shows the modular platform system in the duo embodiment which contains the same pieces shown in FIG. 1

Figure 22:
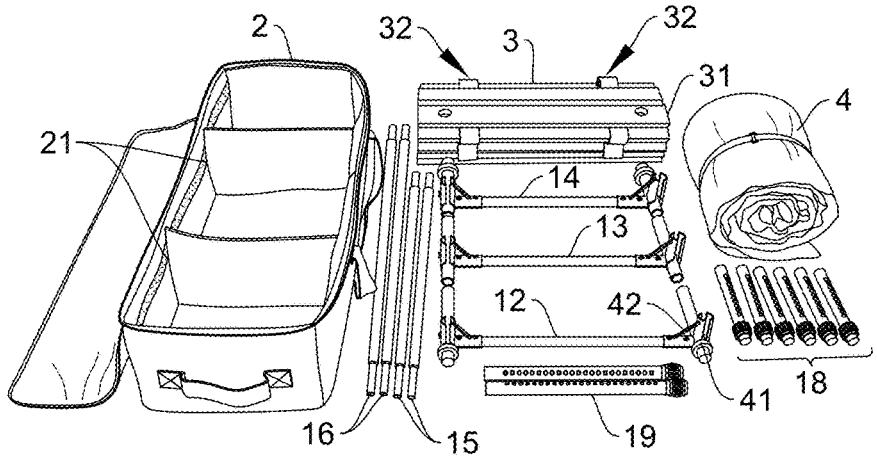
FIG. 22 is an exploded view showing all pieces included in the solo embodiment of the modular vehicle platform system.

FIG. 22 which shows the same modular vehicle platform system 10 in the solo embodiment as FIG. 1 with the addition of a mattress 4.

Figure 23:
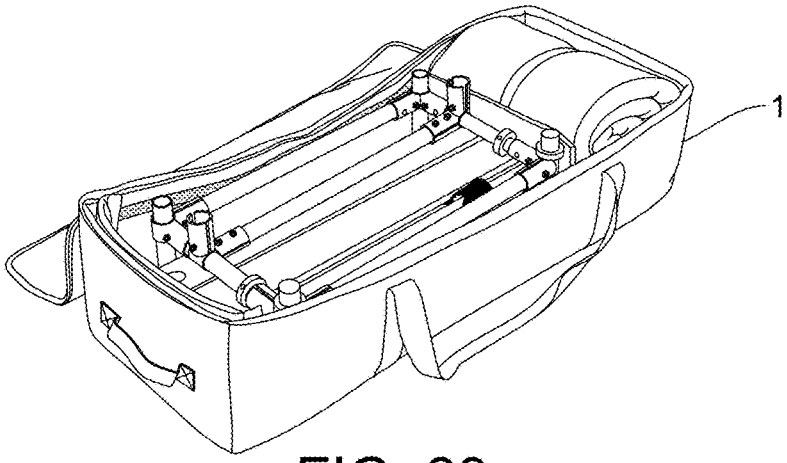
FIG. 23 is a perspective view of the modular vehicle platform system 10 packed in the carrying case.

FIG. 23 which shows the modular vehicle platform system 10 in the solo embodiment as in FIG. 22 put away in the carrying case 2.

Figure 24:
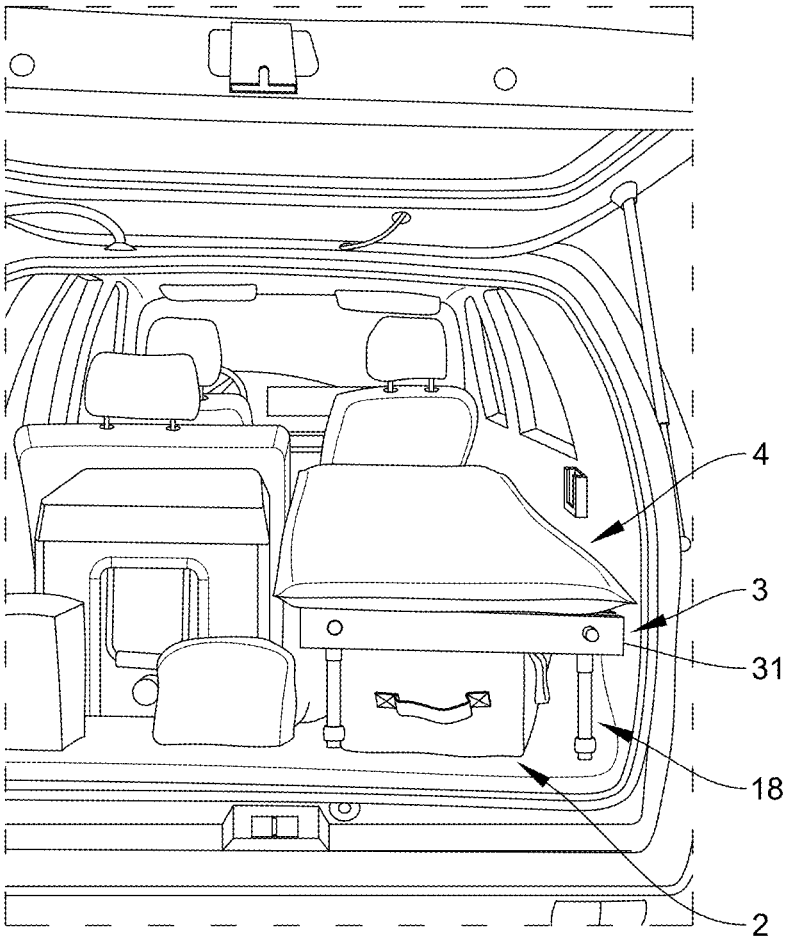
FIG. 24 is a rear view of the preferred embodiment of the modular vehicle platform system while in the sleeping platform configuration installed in the back of a vehicle.

FIG. 24 which shows the modular vehicle platform system 10 in a rear perspective view installed in a vehicle. The modular vehicle platform system 10 has the mattress 4 placed on the topper 3. Topper 3 has a plurality of slats 31. The Topper 3 connects to the frame 11 by connecting the slats 31 to the plurality of shaft collars 41. The modular vehicle platform system 10 is configured with the plurality of short legs 18.

Figure 25:
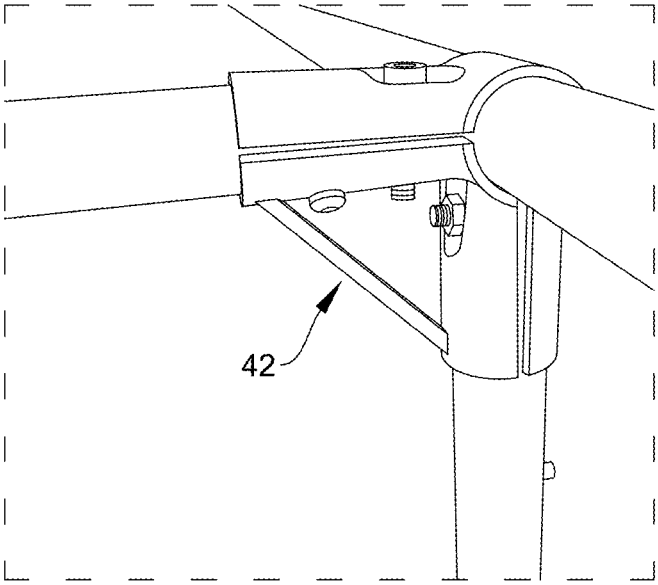
FIG. 25 is a detailed close-up view of the reinforced angle brackets.

FIG. 25 which is a detailed close-up view of a reinforced angle bracket 42.

Figure 26:
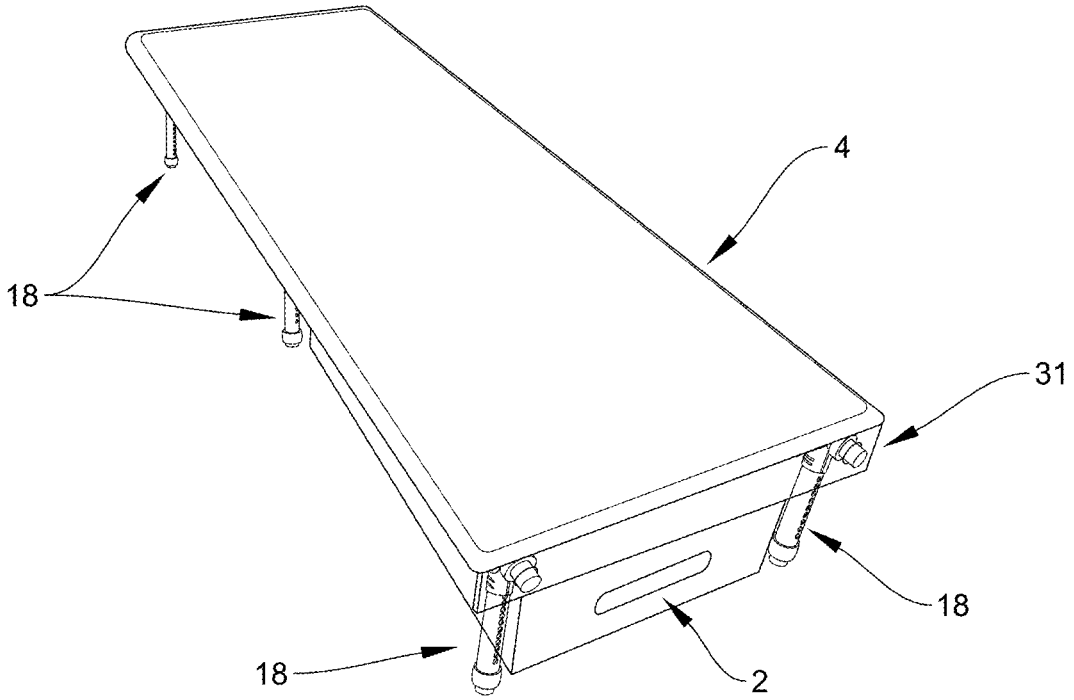
FIG. 26 is a perspective view of the modular vehicle platform system assembled in the sleeping platform configuration with the mattress and carrying case.

FIG. 26 which is a perspective view of the modular vehicle platform system 10 with the mattress 4 on the top of the plurality of slats 31 attached the frame which is using a plurality of short legs 18. The carrying case 2 is underneath the modular vehicle platform system 10 in its preferred embodiment.

Figure 27:
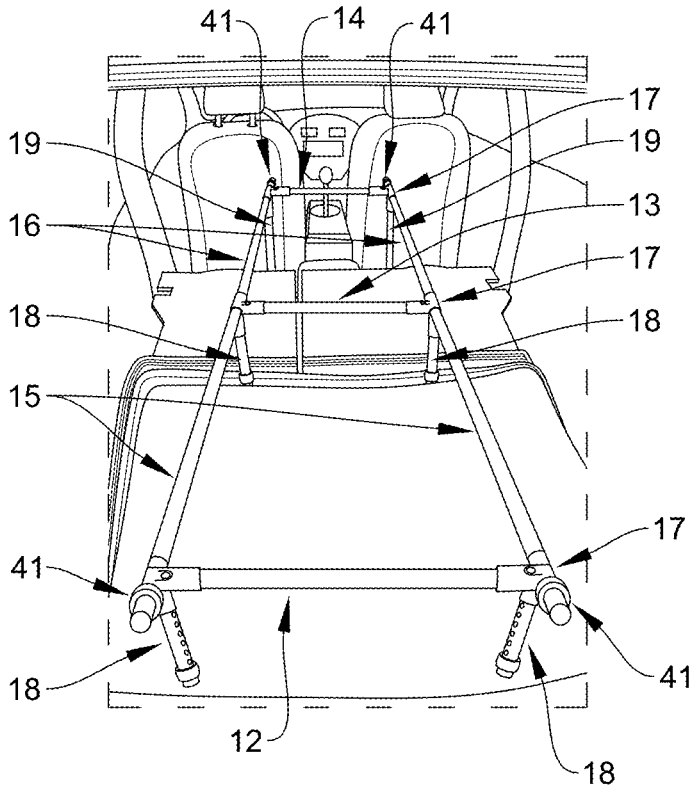
FIG. 27 is a perspective rear view of the modular vehicle platform system in the sleeping platform configuration with no topper.

FIG. 27 which is a rear perspective view of the modular vehicle platform system 10 in the same configuration as FIG. 19, but positioned in the middle of a vehicle.

Figure 28:
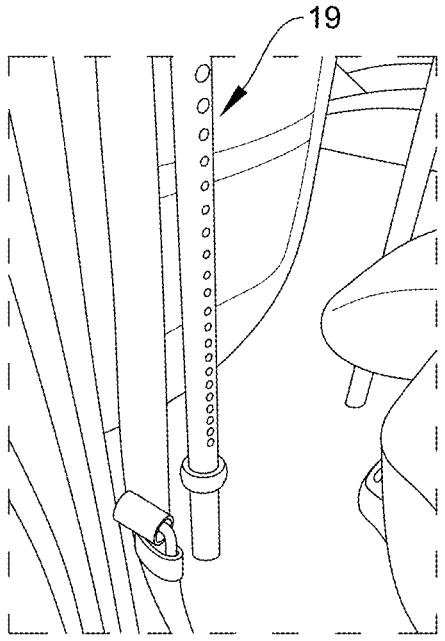
FIG. 28 is a close-up view of an extendable leg installed in a vehicle's footwell.

FIG. 28 which is a close-up view of an extendable leg 19 in a vehicle's footwell showing the preferred embodiment of the modular vehicle platform system 10 when installed in a vehicle that allows for an extendable leg 19 connected to the rear center support bar 12.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An apparatus comprising:

a topper, wherein the topper comprises:

a plurality of slats that includes a rear slat, a front slat, and at least two slats distributed between the rear slat and the front slat, wherein the rear slat has at least two openings, and wherein the front slat has at least two openings; and a plurality of stretchable straps, wherein each of the slats attaches to each of the stretchable straps; and a frame, wherein the frame comprises:

a rear center support bar, wherein the rear slat of the topper is configured to attach to ends of the rear center support bar via the openings on the rear slat;

a middle center support bar;

a front center support bar, wherein the front slat of the topper is configured to attach to ends of the front center support bar via the openings on the front slat, and wherein when the rear slat of the topper is attached to the rear center support bar and the front slat of the topper is attached to the front center support bar, then the stretchable straps extend between the rear center support bar and front center support bar;

a plurality of shaft collars disposed on the rear center support bar and the front center support bar, wherein when the topper is attached to the rear center support bar and the front center support bar, slats of the topper contact the shaft collars;

a plurality of short poles that extend between the rear center support bar and the middle center support bar, wherein the short poles define a fixed short distance between the rear center support bar and the middle center support bar;

a plurality of long poles that extend between the middle center support bar and the front center support bar, wherein the long poles define a fixed long distance between the middle center support bar and the front center support bar, and wherein the short poles and the long poles are selectively removable from the frame to configure the frame into a plurality of platform configurations;

a plurality of angle brackets;

a plurality of short legs, wherein the short legs extend from ends of the rear center support bar, the middle center support bar, and the front center support bar via the angle brackets, and wherein the short legs extend vertically downward from the angle brackets; and a plurality of extendable legs, wherein the extendable legs are interchangeable with the short legs to extend from the rear center support bar, the middle center support bar, or the front center support bar via the angle brackets, and wherein the extendable legs extend vertically downward from the angle brackets.

2. The apparatus of claim 1, wherein the topper comprises a plurality of gripping strips disposed above one or more of the slats.

3. The apparatus of claim 1, wherein the apparatus is configurable into a plurality of platforms, and wherein each of the platforms provides storage underneath.

4. The apparatus of claim 3, wherein one of the platforms is a sleeping platform, wherein the topper is configured to be supported above the sleeping platform, and wherein a mattress is supportable above the topper.

5. The apparatus of claim 3, wherein one of the platforms is a table platform, wherein the table platform has a length that is adjustable.

6. The apparatus of claim 3, wherein one of the platforms is a table platform, wherein the table platform has a height that is adjustable.

7. The apparatus of claim 1, further comprising:

a carrying case having a base, end walls, and side walls, wherein each of the end walls have an interior surface and an exterior surface, wherein each of the side walls have an interior surface and an exterior surface, wherein the end walls and side walls are attached to and extend upward from the base, wherein the carrying case comprises:

a plurality of adjustable partitions.

8. The apparatus of claim 1, wherein each of the short and long legs has a dual locking mechanism comprising:

a spring-loaded button clip to hold the legs in place in half inch increments; and a twist-lock mechanism located at the end of each leg.

9. The apparatus of claim 1, wherein the topper supports a single or queen mattress.

10. The apparatus of claim 1, wherein at least one of the slats distributed between the rear slat and the front slat includes at least one opening.

11. A modular vehicle platform system comprising:

a topper, wherein the topper comprises:

a plurality of slats that includes a rear slat, a front slat, and at least two slats distributed between the rear slat and the front slat, wherein the rear slat has at least two openings, and wherein the front slat has at least two openings; and a plurality of stretchable straps, wherein each of the slats attaches to each of the stretchable straps; and a frame, wherein the frame comprises:

a rear center support bar, wherein the rear slat of the topper is configured to attach to ends of the rear center support bar via the openings on the rear slat;

a middle center support bar;

a front center support bar, wherein the front slat of the topper is configured to attach to ends of the front center support bar via the openings on the front slat, and wherein when the rear slat of the topper is attached to the rear center support bar and the front slat of the topper is attached to the front center support bar, then the stretchable straps extend between the rear center support bar and front center support bar;

a plurality of shaft collars disposed on the rear center support bar and the front center support bar, wherein when the topper is attached to the rear center support bar and the front center support bar, slats of the topper contact the shaft collars;

a plurality of short poles that extend between the rear center support bar and the middle center support bar, wherein the short poles define a fixed short distance between the rear center support bar and the middle center support bar;

a plurality of long poles that extend between the middle center support bar and the front center support bar, wherein the long poles define a fixed long distance between the middle center support bar and the front center support bar, and wherein the short poles and the long poles are selectively removable from the frame to configure the frame into a plurality of platform configurations;

a plurality of angle brackets;

a plurality of interchangeable legs, wherein the interchangeable legs extend from ends of the rear center support bar, the middle center support bar, and the front center support bar via the angle brackets, and wherein the interchangeable legs extend vertically downward from the angle brackets; and a carrying case having a base, end walls, and side walls, wherein each of the end walls have an interior surface and an exterior surface, wherein each of the side walls have an interior surface and an exterior surface, wherein the end walls and side walls are attached to and extend upward from the base, wherein the carrying case includes a plurality of adjustable partitions and a plurality of fastening strips that run lengthwise along the interior surfaces of the side walls, and wherein the carrying case is configured to be positioned underneath the frame.

12. The modular vehicle platform system of claim 11, wherein the interchangeable legs are selected from the group consisting of: short legs and extendable legs.

13. The modular vehicle platform system of claim 11, wherein components of the frame and the topper are storable within the carrying case.

14. The modular vehicle platform system of claim 11, wherein at least one of the slats distributed between the rear slat and the front slat includes at least one opening.

* * * * *